US007721399B2

(12) United States Patent
Tedesco

(10) Patent No.: US 7,721,399 B2
(45) Date of Patent: May 25, 2010

(54) METHOD FOR REPLACING A TELESCOPING CYLINDER IN A RECONFIGURABLE CHAIR

(75) Inventor: Romeo Tedesco, Thornhill (CA)

(73) Assignee: Global Total Office an Ontario Limited Partnership having Global Upholstery Co.Inc. as its General Partner, Downsview, Ontario (CA)

( * ) Notice: Subject to any disclaimer, the term of this patent is extended or adjusted under 35 U.S.C. 154(b) by 120 days.

(21) Appl. No.: 11/775,261

(22) Filed: Jul. 10, 2007

(65) Prior Publication Data

US 2008/0010802 A1 Jan. 17, 2008

Related U.S. Application Data

(62) Division of application No. 11/257,076, filed on Oct. 25, 2005, now abandoned.

(51) Int. Cl.
*B23P 19/04* (2006.01)

(52) U.S. Cl. ..... 29/402.08

(58) Field of Classification Search ..... 29/402.03, 29/402.08, 428, 426.1, 458, 456, 435, 505; 297/344.16, 461, 423.1; 600/585, 433–436; 140/71 R; 428/600, 607, 660
See application file for complete search history.

(56) References Cited

U.S. PATENT DOCUMENTS

| | | | |
|---|---|---|---|
| 2,579,305 | A | 12/1951 | Cushman |
| 2,653,648 | A | 9/1953 | Marshall |
| 2,863,494 | A | 12/1958 | Lautier et al. |
| 3,145,052 | A | 8/1964 | Morgan |
| 3,223,072 | A | 12/1965 | Bross |
| 3,284,135 | A | 11/1966 | Hiramatsu |
| 3,368,845 | A | 2/1968 | Watanabe |
| 3,578,379 | A | 5/1971 | Taylor et al. |
| 3,730,019 | A | 5/1973 | Ballard |
| 3,889,998 | A | 6/1975 | Weiland |
| 4,072,288 | A | 2/1978 | Wirges et al. |
| 4,076,308 | A | 2/1978 | Slabon et al. |
| 4,328,943 | A | 5/1982 | Eldon, III |
| 4,353,594 | A | 10/1982 | Lowe |
| 4,354,398 | A | 10/1982 | Porter |
| 4,370,001 | A | 1/1983 | Ornberg |
| 4,373,692 | A | 2/1983 | Knoblauch et al. |
| 4,383,714 | A | 5/1983 | Ishida |
| 4,408,800 | A | 10/1983 | Knapp |
| 4,456,298 | A | 6/1984 | Gottstein |
| 4,595,237 | A | 6/1986 | Nelsen |
| 4,681,369 | A | 7/1987 | Simpson |
| 4,684,173 | A | 8/1987 | Locher |

(Continued)

FOREIGN PATENT DOCUMENTS

| | | | |
|---|---|---|---|
| DE | 4114101 | A1 | 5/1992 |

(Continued)

*Primary Examiner*—John C Hong
(74) *Attorney, Agent, or Firm*—Philip C. Mendes de Costa; Bereskin & Parr LLP/S.E.N.C.R.L., s.r.l.

(57) ABSTRACT

A chair, which has a cylinder for controlling the configuration of a chair or the seat height of a chair, is operated by a flexible cable. The flexible cable is attached to an adjustment member that is not fixedly attached to the cylinder, thereby permitting the cylinder to be replaced without replacing the adjustment member.

15 Claims, 3 Drawing Sheets

U.S. PATENT DOCUMENTS

| | | | |
|---|---|---|---|
| 4,720,143 | A | 1/1988 | Schwartz et al. |
| 4,743,065 | A | 5/1988 | Meiller et al. |
| 4,778,216 | A | 10/1988 | Stupakis |
| 4,787,673 | A | 11/1988 | Locher |
| 4,838,510 | A | 6/1989 | Holstensson |
| 4,916,968 | A | 4/1990 | Kabaya |
| 4,956,755 | A | 9/1990 | Maglica et al. |
| 5,024,484 | A | 6/1991 | Buchacz |
| 5,029,822 | A | 7/1991 | Selzer |
| 5,069,496 | A | 12/1991 | Kunh et al. |
| 5,090,770 | A | 2/1992 | Heinrichs et al. |
| 5,137,330 | A | 8/1992 | Lie et al. |
| 5,222,783 | A | 6/1993 | Lai |
| RE34,381 | E | 9/1993 | Barnes |
| 5,456,448 | A | 10/1995 | Chou |
| 5,577,804 | A | 11/1996 | Tedesco |
| 5,671,972 | A | 9/1997 | Tedesco |
| 5,899,530 | A | 5/1999 | Tedesco |
| 6,019,429 | A | 2/2000 | Tedesco |
| 6,079,786 | A | 6/2000 | Kirkland et al. |
| 6,224,155 | B1 | 5/2001 | Dekraker et al. |
| 6,276,756 | B1 | 8/2001 | Cho et al. |
| 7,007,587 | B2 | 3/2006 | Zanden |
| 7,017,872 | B2 | 3/2006 | Hogle et al. |
| 7,059,592 | B2 | 6/2006 | Huh et al. |

FOREIGN PATENT DOCUMENTS

| | | | |
|---|---|---|---|
| EP | 052832 | A2 | 6/1982 |
| EP | 208127 | A2 | 1/1987 |
| EP | 250207 | A2 | 12/1987 |
| EP | 329455 | A1 | 8/1989 |
| JP | 5024467 | | 2/1993 |
| JP | 6277126 | | 10/1994 |
| NL | 7907059 | | 4/1980 |

METHOD FOR REPLACING A TELESCOPING CYLINDER IN A RECONFIGURABLE CHAIR

This application is a division of application Ser. No. 11,257,076 filed on Oct. 25, 2005, which is still pending.

FIELD OF THE INVENTION

This invention relates to a chair, such as an office chair, which is reconfigurable by actuating a telescoping cylinder.

BACKGROUND OF THE INVENTION

Many chairs that are used in commercial environments, such as office chairs, have a height adjustment mechanism for permitting the height of the chair to be raised or lowered to accommodate a user. Typically, the height adjustment mechanism includes a cylinder, such as a pneumatic cylinder (also known in the industry as a gas damper). By opening a valve in the cylinder, the height of the seat, with respect to the floor engaging portion of the chair, may be adjusted.

Many such chairs also have a seat tilt and/or a back tilt mechanism. Accordingly, the inclination of the seat and/or the inclination of the back rest may be adjusted. In some cases, synchronous tilt mechanisms are used, whereby the adjustment of the angle of the backrest occurs concurrently with the adjustment of the inclination of the seat. These adjustment mechanisms may also utilize a telescoping cylinder.

Mechanisms to adjust the height of a seat, the angle of inclination of a seat and the angle of the inclination of a backrest using a Bowden cable that is actuated by a push button are known. See for example U.S. Pat. Nos. 5,577,804 and 6,019,429 by the applicant.

From time to time, a cylinder may be damaged during use, or a seal may fail. In such cases, the cylinder must be replaced if the chair is to maintain its functionality.

SUMMARY OF THE INVENTION

In accordance with the instant invention, a simplified adjustment mechanism for a cylinder is provided. The adjustment member is mounted directly on the cylinder and may seat thereon. Accordingly, the adjustment mechanism is removably mounted to the cylinder. One advantage of this approach is that, if a cylinder has to be replaced, the adjustment mechanism need not be replaced. Accordingly, a serviceman may simply disengage the cylinder from the adjustment member and remove the cylinder from the chair. A replacement cylinder may then be inserted into the chair and the same adjustment member may be removably attached to the new cylinder. Accordingly, it is not necessary to disengage the cable from the adjustment mechanism.

Another advantage of the instant invention is that the adjustment mechanism provides a simplified construction which is suitable for mass production and, preferably, is made by molding and, more preferably, by injection molding. Accordingly, a low cost, durable adjustment member may be obtained.

In accordance with one aspect of the instant invention, there is provided a chair comprising:

(a) a telescoping cylinder having a first end connected to a first portion of the chair, a second end distal to the first end and connected to a second portion of the chair, and a valve provided on the first end of the cylinder, whereby when the cylinder telescopes, the first portion of the chair is moved with respect to the second portion of the chair;

(b) an adjustment member having a moveable member that is operably connected to the valve when the adjustment member is mounted to the cylinder and the moveable member is removably mounted to the cylinder;

(c) a flexible cable extending between the actuator and the adjustment member and the moveable member is operable by movement of the flexible cable to open the valve; and, (d) an actuator operable by a person and drivingly connected to the adjustment member.

In one embodiment, the adjustment member has a housing configured to be mounted to the cylinder.

In another embodiment, the adjustment member has a first portion having the moveable member, the housing is non-removably mounted to the cylinder and the first portion is removably mounted to the housing.

In another embodiment the housing includes a sleeve sized to receive therein the first end of the cylinder.

In another embodiment the sleeve is sized to slidingly lockingly receive therein the first end of the cylinder.

In another embodiment the first portion and the housing are secured together by mechanical engagement members.

In another embodiment the mechanical engagement members comprise screws.

In another embodiment the adjustment member comprises a first portion having the moveable member and the portion having the moveable member is not permanently affixed to the cylinder.

In another embodiment the adjustment member has a housing configured to be removably mounted to the cylinder and a first portion having the moveable member connected to the housing.

In another embodiment the housing includes a sleeve sized to receive therein the first end of the cylinder.

In another embodiment the sleeve is sized to slidingly receive therein the first end of the cylinder.

In another embodiment the adjustment member is made of plastic.

In another embodiment the adjustment member is made by molding.

In accordance with another aspect of the instant invention, there is provided a chair comprising an adjustment mechanism for a chair having a telescoping cylinder, the telescoping cylinder comprising a valve actuated via a flexible cable, a first end connected to a first portion of the chair and having the valve, and a second end distal to the first end and mounted to a second portion of the chair, the first portion of the chair is moveable with respect to the second portion of the chair, the adjustment member comprising a moveable member that is operated by movement of the flexible cable to open the valve wherein at least a portion of the adjustment member having the moveable member is removably mounted to the cylinder.

In one embodiment the adjustment member has a housing configured to receive therein the first end of the cylinder.

In another embodiment the housing includes a sleeve sized to receive therein the first end of the cylinder.

In another embodiment the adjustment member comprises a first portion having the moveable member and a second portion adapted to be fixedly mounted to the cylinder, the first portion being removably mountable to the second portion.

In another embodiment the first and second portions are secured together by mechanical engagement members.

In another embodiment the mechanical engagement members comprise screws.

In another embodiment the second portion of the adjustment member comprises a housing configured to receive therein the first end of the cylinder.

In another embodiment the housing includes a sleeve sized to receive therein the first end of the cylinder.

In another embodiment the sleeve is sized to slidingly lockingly receive therein the first end of the cylinder.

In another embodiment the adjustment member has a housing configured to be removably mounted to the cylinder and a first portion having the moveable member connected to the housing.

In another embodiment the housing includes a sleeve sized to receive therein the first end of the cylinder.

In another embodiment the sleeve is sized to slidingly receive therein the first end of the cylinder.

In another embodiment the adjustment member is made of plastic.

In another embodiment the adjustment member is made by molding.

In accordance with another aspect of the instant invention, there is provided a method of servicing a chair having a flexible cable that acts via an adjustment member to actuate a telescoping cylinder, the telescoping cylinder having a first end having a valve and a distal end, the method comprising:

(a) disconnecting the adjustment member from the cylinder and disengaging the distal end of the cylinder from the chair; and, (b) connecting the adjustment member to a replacement cylinder and engaging the distal end of the replacement cylinder with the chair.

In one embodiment the adjustment member has a sleeve and step (a) comprises sliding the first end of the cylinder out of engagement with the sleeve.

In another embodiment the chair has a seat shroud and the method further comprises removing the seat shroud to access the cylinder prior to sliding the cylinder out of engagement with the adjustment member.

In another embodiment the cylinder comprises part of a seat height adjustment mechanism and extends upwardly from a floor engaging chair base and step (a) includes removing the distal end from the floor engaging chair base.

In another embodiment the adjustment mechanism is mounted to a seat support having a lower surface and step (b) further comprises passing the first end of the replacement cylinder through the lower surface of the seat support prior to sliding the first end of a replacement cylinder into engagement with the adjustment member.

BRIEF DESCRIPTION OF THE DRAWINGS

These and other advantages of the instant invention will be more fully and completely understood by reference to the following drawings of the preferred embodiment of the invention in which.

DESCRIPTION OF THE PREFERRED EMBODIMENT

Figure 1:
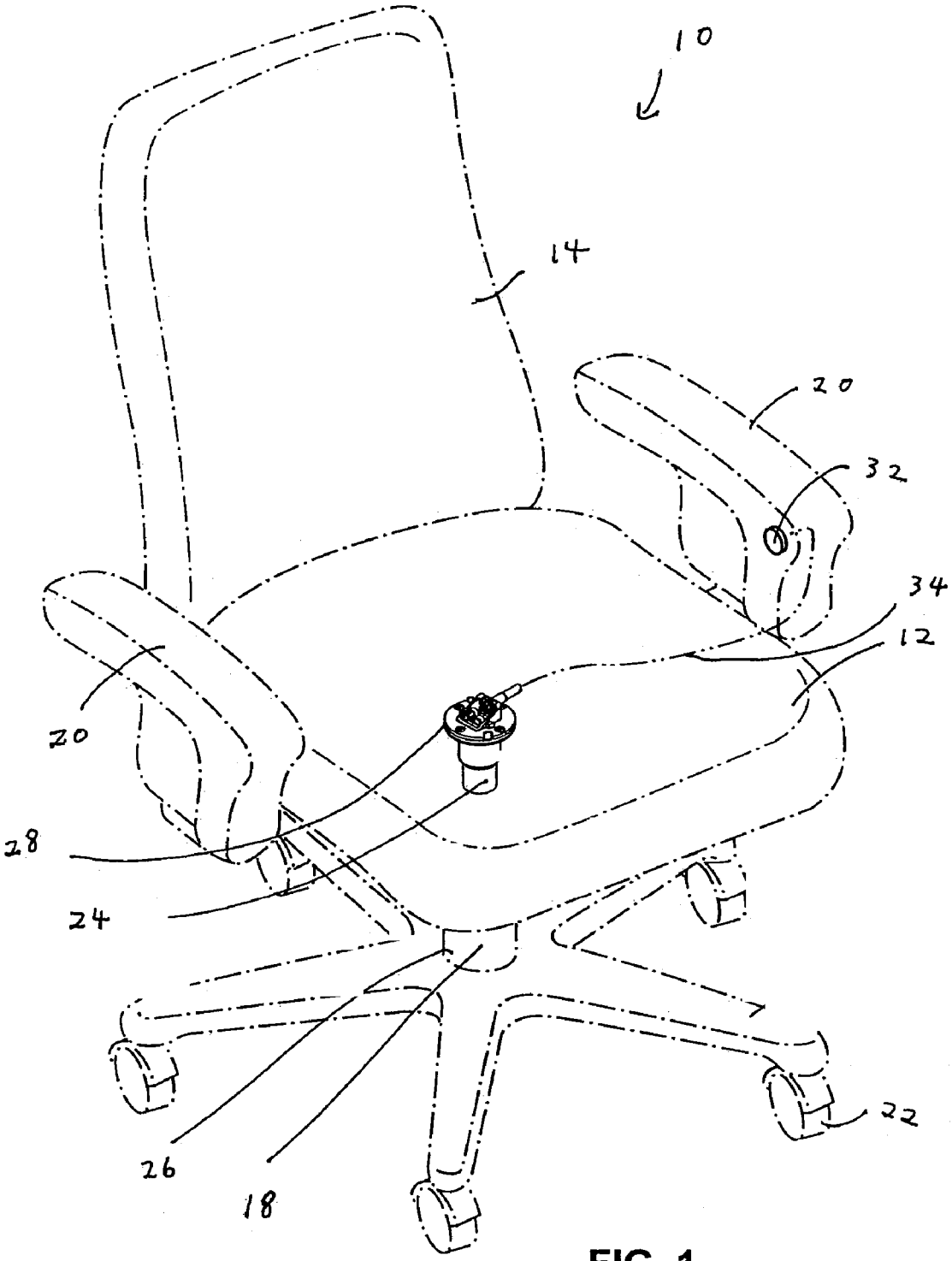
FIG. 1 is a perspective view of a chair according to a first embodiment of the instant invention.

FIG. 1 shows an embodiment of a pedestal or an office chair. In FIG. 1, the chair shown in doted outline except for the adjustment member and the top portion of the height adjustment cylinder.

As shown in FIG. 1, chair 10 comprises a seat 12, a backrest 14, a base 16, a height adjustment cylinder 18 extending between base 16 and the bottom of seat 12 and arms 20 that are provided on opposite sides of seat 12.

It will be appreciated that chair 10 may be of any particular design. Accordingly, in one embodiment, arms 20 need not be provided. In addition, if chair 10 comprises a stool, then a backrest 14 need not be provided. Further, seat 12 and backrest 14 may be of any particular configuration. As shown in FIG. 1, base 16 is a wheeled base, which is provided with a plurality of wheels 22. While the use of a wheeled base is preferred, in another embodiment, base 16 may comprise a slide base or other suitable floor engaging portion for chair 10.

For ease of reference, the invention is described in terms of the use of the adjustment member for a height adjustment cylinder 18. Accordingly, in the embodiment of FIG. 1, seat 12 need not be tiltable. However, it will be appreciated that in other embodiments either or both of seat 12 and backrest 14 may be mounted as is known in the art so as to permit either or both to tilt or rock independently or synchronously. It will be appreciated that if seat and/or backrest 10 are reconfigurable at different angles that a cylinder 18 and an adjustment member as taught herein may be utilized to facilitate such movement. For example, either seat 12 and/or backrest 14 may use a cylinder 18 to control the tilt of the seat and/or backrest 14 as disclosed in U.S. Pat. No. 6,019,429 or by any other means known in the art. In any instance in which a cylinder 18 is used to control the reconfiguration of a chair, an adjustment member as disclosed herein may be used.

Cylinder 18 has a first end or a valve end 24 and a second end or distal end 26. Such cylinders are generally known in the art and typically have two internal chambers that are in flow communication via a passage having a valve (not shown). When the valve is in the closed position, the chambers are isolated from each other. Accordingly, the length of the cylinder, and therefore the height of the chair or the configuration of a chair, is locked in a position. When the valve is moved to the open position, the two chambers are allowed to communicate permitting fluid to flow therebetween. Accordingly, the height of the chair or the configuration of the chair may be adjusted. Typically, a cylinder has a valve release pin 30, which is drivingly connected to the valve of the cylinder. Accordingly, when valve release pin 30 is actuated, the valve of cylinder 18 is opened.

In accordance with this invention, an actuator 32, an adjustment member 28 and a flexible cable 34 extending between actuator 32 and adjustment member 28 are provided. It will be appreciated that actuator 32 may be provided at any location on chair 12. In a preferred embodiment shown in FIG. 1, actuator 32 is provided in an arm 20 of a chair. However, it will be appreciated that actuator 32 may be provided at any other location on the chair and is preferably located at a position whereby actuator 32 may be operated by a user when sitting in chair 12. For example, actuator 32 may be provided on the side of seat 12. It will also be appreciated that if the chair has more than one cylinder 18, then each cylinder 18 may be operated by a different actuator 32. In addition, in an alternate embodiment, a single actuator 32 may be used to operate two or more cylinders 18.

Figure 4:
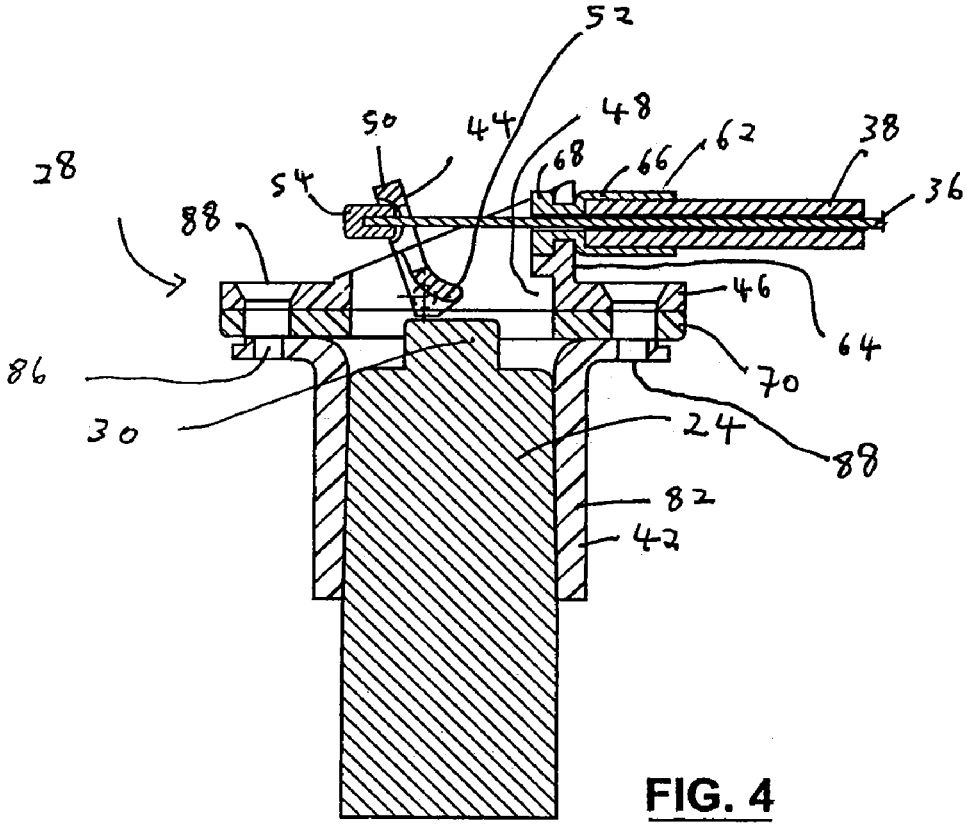
FIG. 4 is a cross section along the line 4-4 of FIG. 2 wherein the valve of the cylinder is closed; and, FIG. 5 is a cross section along the lines 4-4 in FIG. 2 wherein the valve of the cylinder is open.
Figure 5:
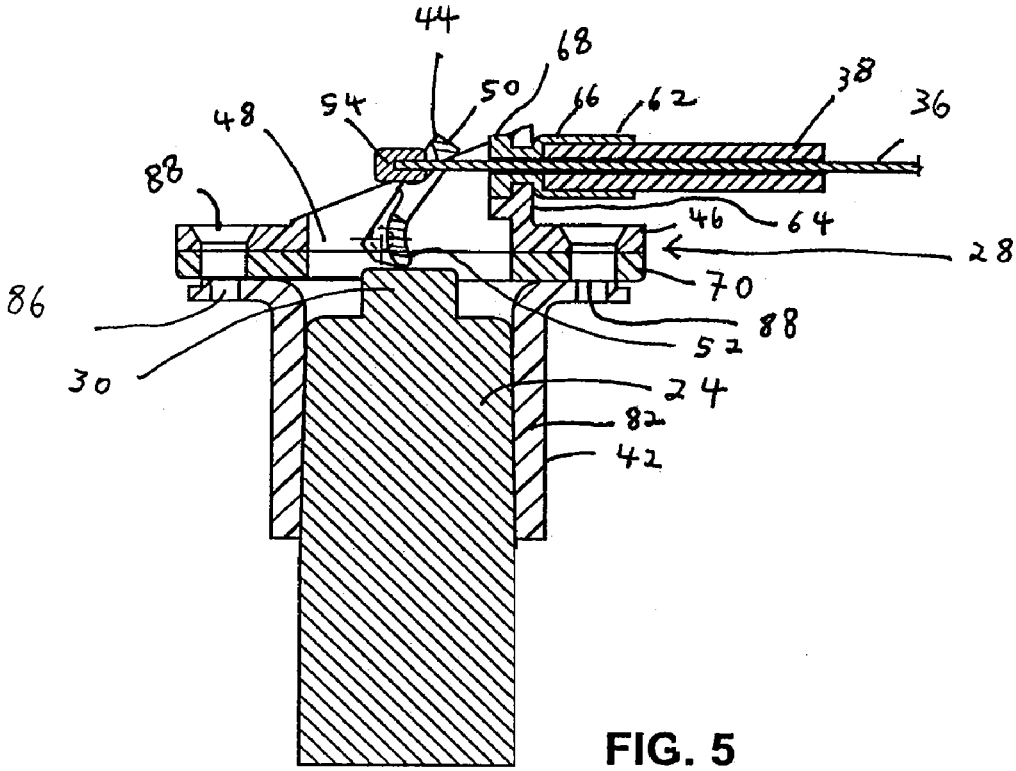

Flexible cable 34 may be any such cable known in the art and, may be a Bowden cable. As shown in FIGS. 4 and 5, flexible cable 34 may be a longitudinally extending cable 36, which is slideably received in a sheath 38.

Typically, cylinder 18 is configured such that valve release pin 30 is biased to the valve closed position which is shown in FIG. 4. Accordingly, in order to adjust the height of chair 10 or re-configure chair 10, valve release pin 30 must be depressed. To this end, adjustment member 28 is configured such that when cable 36 is moved by means of actuator 32, valve release pin 30 is moved to the open position. Accordingly, actuator 32 may be of any configuration whereby, when used, actuator 32 tensions cable 36 thereby operating adjustment member 28. When cable 36 is under sufficient tension, adjustment member 28 operates valve release pin 30 to open the valve of cylinder 18. Such actuators are shown in U.S. Pat. Nos. 5,577,804 and 6,019,429. Any such actuator known in the art may be utilized. In a particularly preferred embodiment, actuator 32 is a button. In an alternate embodiment, it will be appreciated that actuator 32 may be a lever, a rocker switch or the like.

Referring to FIGS. 2-5, adjustment member 28 comprises a first portion 40 and a housing 42. First portion 40 is provided with a movable member 44. Movable member 44 is operably connected to the valve (e.g. via valve release pin 30) such that when cable 36 is tensioned, movable member 44 causes valve release pin 30 to move thereby opening the valve of cylinder 18. It will be appreciated that since valve release pin 32 may be biased to the valve closed position, valve release pin 30 may be utilized to move movable member 44 back to the position shown in FIG. 4 when the tension in cable 36 is released, such as by a user no longer pressing on actuator 32.

First portion 40 may comprise at least a top member 46. Top member 46 is configured to receive movable member 44 and permit movable member 44 to interact with valve release pin 30. Accordingly, top member 46 may be positioned above cylinder 18 and may be provided with a central opening 48 through which movable member 44 extends downwardly to interact with valve release pin 30. Movable member 44 has an upper portion 50, which is engaged by cable 36, and a lower portion 52, which interacts with valve release pin 30.

Movable member 44 may be movably mounted to top member 46 by any means known in the art. Preferably, movable member 44 is pivotally mounted to top member 46. Accordingly, movable member may be provided with pivot pins 58 (which may be integrally molded with movable member 44). Top member 46 may be provided with recesses 60 that are configured to receive pivot pins 58. Accordingly, when cable 36 is tensioned, moveable member will pivot thereby causing lower portion 52 to drivingly operate pivot pin 30.

Figure 2:
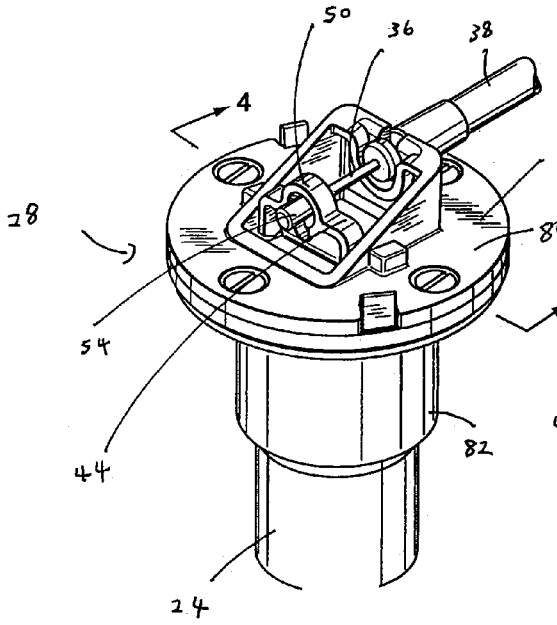
FIG. 2 is a perspective view of an adjustment member mounted on the top of a cylinder according to one embodiment of this invention.
Figure 3:
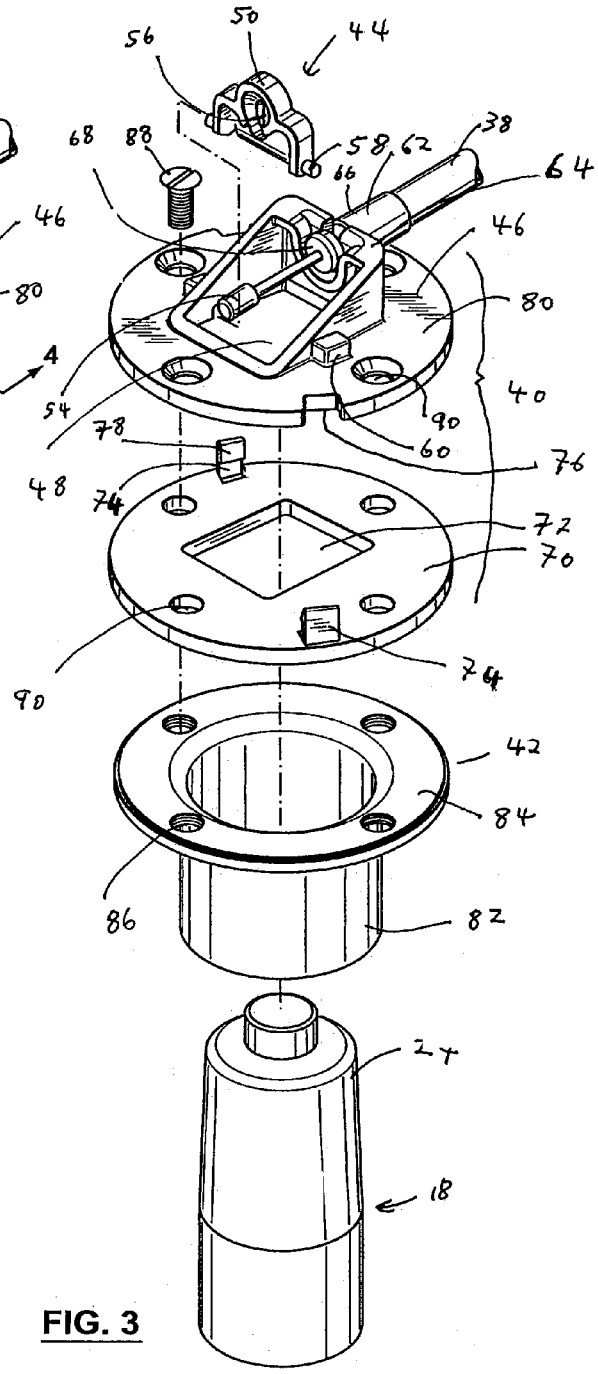
FIG. 3 is an exploded view of FIG. 2.

Flexible cable 34 may be drivingly connected to adjustment member 28 as shown in FIGS. 4 and 5. As shown therein, cable 36 may have an end cap 54 that is secured thereto. Accordingly, during manufacturing, cable 36 may be passed through opening 56 in upper portion 50 of movable member 44 and then end cap 54 may be secured thereto. End cap 54 is sized so as to prevent end cap 54 from passing through opening 56. Accordingly, when tension is applied to cable 36, end cap 54 will abut against movable member 50. Top member 46 is provided with a member for permitting end cap 54 to move relative to distal end 62 of sheath 38. For example, distal end may abut against the rear surface of wall 64, which is opposite to moveable member 44. Alternately, as shown in FIGS. 2 and 3, top member 46 may be configured to secure distal end 62 in a fixed position. Accordingly, wall 64 may be provided with a central opening for receiving and securing in place distal end 62. Distal end 62 may be provided with an end member 66 that has a narrowed portion, which is received in the opening in wall 64, and a disk shaped end 68. Thus, when end member is inserted into the opening in wall 64, disk shaped end 68 abuts against the front face of wall 64. Accordingly, when cable 36 is tensioned, end cap 54 and top portion 50 of moveable member 44 are moved towards wall 64. It will be appreciated that any other means for securing the distal end 62 of a Bowden cable in place may be utilized, including those means known in the bicycle art.

In operation, when a user actuates actuator 32 (e.g. the user presses on a button), cable 36 is tensioned and, accordingly, end cap 54 is drawn towards wall 64. As end cap 54 can not pass through opening 56, and as movable member 44 is pivotally mounted to top member 46, tensioning cable 36 will cause upper portion 50 of movable member 44 to be drawn towards wall 64 (to the position shown in FIG. 5). This will cause lower portion 52 of movable member 44 to press downwardly on valve release pin 30 thereby opening the valve of cylinder 18. When pressure is released from cable 36 (e.g. a user no longer presses on actuator 32), then the pressure of the fluid in cylinder 18 will cause valve release pin 30 to move upwardly thereby causing upper portion 50 of movable member 44 to be pushed back to the position shown in FIG. 4.

As shown in FIG. 3, first portion 40 comprises a top member 46 and a lower member 70. Preferred optional lower member 70 is essentially disk shaped having a central opening 72. Preferably, top member 46 and lower member 70 may be secured together by any means known in the art and, are preferably removably connected together. For example, as shown in FIG. 3, lower portion 70 is provided with upstanding arms 74 and top member 46 is provided with a recess 76 for each arm 70. In order to assemble first portion 40, recesses 76 may be aligned with arms 74. The inner top portion 78 of arm 74 may have a cam surface such that when top member 46 is lowered onto lower member 70, arms 74 move outwardly to permit top member 46 to be placed in abutting relationship with lower member 70 and, when this position has been achieved, to move inwardly so as to abut against the upper surface 80 of top member 46, thereby holding top member 46 in position.

It will be appreciated that each of movable member 44, top member 46 and optional lower member 70 may be made of plastic and, may be made by molding, such as injection molding. Accordingly, each of the parts that make up first portion 40 may be manufactured to a high degree of quality and may be easily assembleable.

In accordance with a first embodiment of the instant invention, adjustment member 28 includes housing member 42. Housing member 42 is configured to be mounted to cylinder 18. Preferably, housing 42 is removably mounted to cylinder 18. If first portion 40 is removably mounted to housing 42, then housing 42 may be permanently connected to cylinder 18 or may be removably mounted to cylinder 18. Alternately, if first portion 40 is not removably mounted to housing 42, then housing 42 is removably mounted to cylinder 18. Preferably, first portion 40 is removably mounted to housing 42.

In a particularly preferred embodiment as shown in FIG. 3, housing 42 comprises a sleeve 82 which slidably receives therein first end 24 of cylinder 18. It will be appreciated that first end 24 may be tapered. Accordingly, sleeve 82 may have a corresponding taper.

As shown in FIG. 3, sleeve 82 may have a flange 84 provided thereon (and preferably integrally molded therewith). Flange 84 may be provided with a plurality of openings 86 which are preferably threaded for receiving a screw 88. Top member 46 and lower member 70 are each provided with openings 90 through which screw 88 may be passed. Accordingly, adjustment member 28 may be assembled by snapping top member 46 into lower member 70 and then securing first portion 40 to housing 42 by aligning openings 86 and 90 and subsequently threading screws 88 into holes 86. It will be appreciated that first portion 40 may be removably attached to housing 42 by any other means known in the art.

Cylinder 18 may be incorporated into a chair by any means known in the art. For example, if cylinder 18 is a height adjustment cylinder, then the cylinder may be inserted into base 16 as is known in the art. Adjustment member 28 may be secured to the seat support mechanism of chair 10. Accordingly, cable 36 may be secured to movable member 44 and housing 42 may be positioned at a location in which first end 24 of cylinder 18 will be received. First end 24 may then be inserted into any seat support mechanism. For example, the seat support mechanism may have an opening sized to removeably receive therein first end 24 of cylinder 18. It will be appreciated that these operations may occur in any desired order. It will also be appreciated that housing 42 may be constructed as part of the seat support mechanism and first portion 40 may be removeably mounted thereto.

If cylinder 18 needs to be replaced, then a serviceman may remove second end 26 of cylinder 18 from base 16 by any means known in the art. Subsequently, the serviceman need only remove first end 24 of cylinder 18 from the seat support mechanism (not shown) by any means known in the art. For example, whether housing 42 is part of the adjustment member 28 or part of the seat support mechanism, first end 24 may be withdrawn from housing 42, e.g. by sliding first end 24 out of housing 42. No additional steps are required to disengage first end 24 from housing 42 as cable 36 is not affixed to cylinder 18. Accordingly, it is not necessary to disengage cable 36 from movable member 44 or to otherwise disassemble adjustment member 28.

In accordance with an alternate embodiment of the instant invention, it will be appreciated that housing 42 may be replaced with cylinder 18. In such a case, first portion 40 is removably mounted to housing 42. Accordingly, first end 24 may be non-removably mounted to cylinder 18 such as by being slidingly lockingly received in sleeve 82. According to this alternate embodiment, when cylinder 18 is to be replaced, first portion 40 must be disconnected from housing 42 (e.g. by removing screws 88). Housing 42 and cylinder 18 may then be removed and a replacement cylinder 18 and replacement housing 42 may be inserted into the chair. First portion 40 may then be removably mounted to the replacement housing 42 such as by aligning holes 86, 90 and inserting screws 88. In this alternate embodiment, it will be appreciated that additional disassembly of chair 10 may be required.

The invention claimed is:

1. A method of servicing a chair having a flexible cable that acts via an adjustment member to actuate a telescoping cylinder, the adjustment member and the telescoping cylinder comprising separate elements, the telescoping cylinder having a first end having a valve and a distal end, the method comprising:

a) disengaging the first end of the cylinder from the chair while maintaining the position of the adjustment member in the chair; and, b) connecting the adjustment member in driving connection to a replacement cylinder and engaging the first end of the replacement cylinder with the chair.

2. The method of claim 1 wherein the adjustment member has a sleeve and step (a) comprises sliding the first end of the cylinder out of engagement with the sleeve.

3. The method of claim 2 wherein the chair has a seat shroud and the method further comprises removing the seat shroud to access the cylinder prior to sliding the cylinder out of engagement with the adjustment member.

4. The method of claim 3 wherein the cylinder comprises part of a seat height adjustment mechanism and extends upwardly from a floor engaging chair base and step (a) includes removing the distal end from the floor engaging chair base.

5. The method of claim 4 wherein the adjustment mechanism is mounted to a seat support having a lower surface and step (b) further comprises passing the first end of the replacement cylinder through the lower surface of the seat support and sliding the first end of a replacement cylinder into position to be drivenly connected with the adjustment member.

6. A method of servicing an office chair having a flexible cable that is driving connected to an adjustment member, wherein the adjustment member is drivingly connected to a telescoping cylinder, the telescoping cylinder having a first end having a valve and a distal end, the method comprising:

a) disengaging the first end of the cylinder from the chair while maintaining the driving connection of the flexible cable and the adjustment member; and, b) engaging the first end of a the replacement cylinder with the chair.

7. The method of claim 6 wherein the office chair has a sleeve and step (a) comprises sliding the first end of the cylinder out of engagement with the sleeve.

8. The method of claim 7 wherein the office chair has a seat shroud and the method further comprises removing the seat shroud to access the cylinder prior to sliding the cylinder out of engagement with the sleeve.

9. The method of claim 6 wherein the cylinder comprises part of a seat height adjustment mechanism and extends upwardly from a floor engaging chair base and step (a) includes removing the distal end from the floor engaging chair base.

10. The method of claim 9 wherein the adjustment mechanism is mounted to a seat support having a lower surface and step (b) further comprises passing the first end of the replacement cylinder through the lower surface of the seat support and sliding the first end of a replacement cylinder into position to be drivenly connected with the adjustment member.

11. A method of replacing a telescoping cylinder that comprises part of a seat height adjustment mechanism of a chair, wherein the seat height adjustment mechanism comprises a flexible cable that is drivingly connected to an adjustment member, wherein the adjustment member is drivingly connected to the telescoping cylinder, the telescoping cylinder having a first end having a valve and a distal end, the method comprising:

a) removing the first end of the cylinder from the chair while maintaining the driving connection of the flexible cable and the adjustment member; and, b) engaging the first end of a the replacement cylinder with the chair.

12. The method of claim 11 wherein the chair has a sleeve and step (a) comprises sliding the first end of the cylinder out of engagement with the sleeve.

13. The method of claim 12 wherein the chair has a seat shroud and the method further comprises removing the seat shroud to access the cylinder prior to sliding the cylinder out of engagement with the sleeve.

14. The method of claim 12 step (a) includes removing the distal end from a floor engaging chair base.

15. The method of claim 11 wherein the adjustment mechanism is mounted to a seat support having a lower surface and step (b) further comprises passing the first end of the replacement cylinder through the lower surface of the seat support and sliding the first end of a replacement cylinder into position to be drivenly connected with the adjustment member.

* * * * *